US006035816A

United States Patent [19]

Ogawa et al.

[11] Patent Number: 6,035,816

[45] Date of Patent: Mar. 14, 2000

[54] VALVE TIMING CONTROL DEVICE

[75] Inventors: Kazumi Ogawa; Kenji Fujiwaki, both of Aichi-pref., Japan

[73] Assignee: Aisin Seiki Kabushiki Kaisha, Aichi-pref, Japan

[21] Appl. No.: 09/092,016

[22] Filed: Jun. 5, 1998

[51] Int. Cl.[7] ..... F01L 1/344; F01L 13/00

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,666,914 | 9/1997 | Ushida et al. | 123/90.17 |
| 5,724,929 | 3/1998 | Mikame et al. | 123/90.31 |
| 5,738,056 | 4/1998 | Mikame et al. | 123/90.17 |
| 5,775,279 | 7/1998 | Ogawa et al. | 123/90.17 |
| 5,794,577 | 8/1998 | Kira | 123/90.17 |
| 5,797,361 | 8/1998 | Mikame et al. | 123/90.17 |

FOREIGN PATENT DOCUMENTS

| | | |
|---|---|---|
| 1-92504 | 4/1989 | Japan . |
| 2-50105 | 4/1990 | Japan . |
| 9-60508 | 3/1997 | Japan . |
| 10-47022 | 2/1998 | Japan . |

*Primary Examiner*—Weilun Lo
*Attorney, Agent, or Firm*—Hazel & Thomas, P.C.

[57] ABSTRACT

A valve timing control device for controlling the opening/closing timing of the intake valve or exhaust valve of an internal combustion engine is disclosed, comprising a valve opening/closing rotary shaft rotatably assembled with the cylinder head of the internal combustion engine; a rotation transmitting member mounted around the rotary shaft so as to rotate relative thereto within a predetermined range for transmitting a rotating power from a crank shaft; vanes provided on the rotary shaft or the rotation transmitting member; a fluid chamber formed between the rotary shaft and the rotation transmitting member and halved into advancing chambers and delaying chambers by the vanes; first fluid passages for feeding and discharging a fluid to and from the advancing chambers; second fluid passages for feeding and discharging the fluid to and from the delaying chambers; a refuge hole formed in the rotation transmitting member or the rotary shaft and accommodating therein a lock pin spring-biased toward the rotary shaft or the rotation transmitting member; a fitting hole formed in the rotary shaft or the rotation transmitting member for fitting therein the head portion of the lock pin when the rotary shaft and the rotation transmitting member are synchronized in predetermined relative phases; and a third passage for feeding and discharging the fluid to and from the fitting hole, wherein the first fluid passage or the second fluid passage is made to communicate with the refuge hole so that the first fluid passage or the second fluid passage and the third fluid passage can communicate through the refuge hole in the state where the lock pin comes out of the fitting hole and into the refuge hole.

2 Claims, 4 Drawing Sheets

VALVE TIMING CONTROL DEVICE

BACKGROUND OF THE INVENTION

1. Field of the Invention

The present invention relates to a valve timing control device to be used for controlling the opening/closing timing of an intake valve or an exhaust valve in a valve actuating mechanism of an internal combustion engine.

2. Description of the Related Art

In Unexamined Published Japanese Patent Application No. 1-92504 or Unexamined Published Japanese Utility Model Application No. 2-50105, for example, there is disclosed a valve timing control device of that kind, comprising a rotation transmitting member so mounted around a valve opening/closing rotary shaft (including a cam shaft and an internal rotor integrally mounted on the cam shaft) rotatably assembled with the cylinder head of an internal combustion engine so as to rotate relative thereto within a predetermined range for transmitting a rotating power from a crank shaft; vanes provided on the rotary shaft; a fluid chamber formed between the rotary shaft and the rotation transmitting member and halved into advancing chambers and delaying chambers by the vanes; first fluid passages for feeding and discharging a fluid to and from the advancing chambers; second fluid passages for feeding and discharging the fluid to and from the delaying chambers; a refuge hole formed in the rotation transmitting member and accommodating therein a lock pin spring-biased toward the rotary shaft; a fitting hole formed in the rotary shaft for fitting therein the head portion of the lock pin when the rotary shaft and the rotation transmitting member are synchronized in predetermined relative phases; and a third passage for feeding and discharging the fluid to and from the fitting hole.

The valve timing control device, as described in each of the above-cited patent applications is constructed such that the lock pin is moved against the spring-urging force by the pressure fluid fed to the fitting hole via the third fluid passage thereby to release the locking by the lock pin. The valve timing control device is also constructed such that the feed and discharge of the fluid to and from the third fluid passage are effected simultaneously with the feed and discharge of the fluid to and from the first fluid passage and the second fluid passage. As a result, the displacement transformation (or the relative rotations of the rotary shaft and the rotation transmitting member) may be started prior to the unlocking by the movement of the lock pin. In this case, excessive friction occurs between the lock pin and the fitting hole so that the unlocking by the movement of the lock pin may not be properly effected.

SUMMARY OF THE INVENTION

The invention has been conceived to solve the above-specified problems and has an object to provide a valve timing control device for controlling the opening/closing timing of the intake valve or exhaust valve of an internal combustion engine, comprising a valve opening/closing rotary shaft rotatably assembled with the cylinder head of an internal combustion engine; a rotation transmitting member mounted around the rotary shaft so as to rotate relative thereto within a predetermined range for transmitting rotating power from a crank shaft; vanes provided on the rotary shaft or the rotation transmitting member; a fluid chamber formed between the rotary shaft and the rotation transmitting member and halved into advancing chambers and delaying chambers by the vanes; first fluid passages for feeding and discharging a fluid (which may be either a working oil or pressurized air) to and from the advancing chambers; second fluid passages for feeding and discharging the fluid to and from the delaying chambers; a refuge hole formed in the rotation transmitting member or the rotary shaft and accommodating therein a lock pin spring-biased toward the rotary shaft or the rotation transmitting member; a fitting hole formed in the rotary shaft or the rotation transmitting member for fitting therein the head portion of the lock pin when the rotary shaft and the rotation transmitting member are synchronized in predetermined relative phases; and a third passage for feeding and discharging the fluid to and from the fitting hole, wherein the first fluid passage or the second fluid passage is made to communicate with the refuge hole so that the first fluid passage or the second fluid passage and the third fluid passage can communicate through the refuge hole in the state where the lock pin comes out of the fitting hole and into the refuge hole.

The valve timing control device according to the invention is constructed such that when the lock pin comes out of the fitting hole and into the refuge hole, the first fluid passage or the second fluid passage and the third fluid passage are made to communicate via the fitting hole and the refuge hole. In the state where the head portion of the lock pin is fitted in the fitting holes, therefore, the pressure fluid is fed to the fitting hole via the third fluid passage thereby to move the lock pin against a spring-urging force. When the lock pin comes out of the fitting hole and into the refuge hole, the pressure fluid is fed from the third fluid passage via the fitting hole and the refuge hole into the first fluid passage or the second fluid passage. As a result, the displacement transformation (or the relative rotations of the rotary shaft and the rotation transmitting member) is not started before unlocking by movement of the lock pin. This eliminates the disadvantage of the unlocking by the lock pin being obstructed by the displacement transformation.

DESCRIPTION OF THE PREFERRED EMBODIMENT

Figure 1:
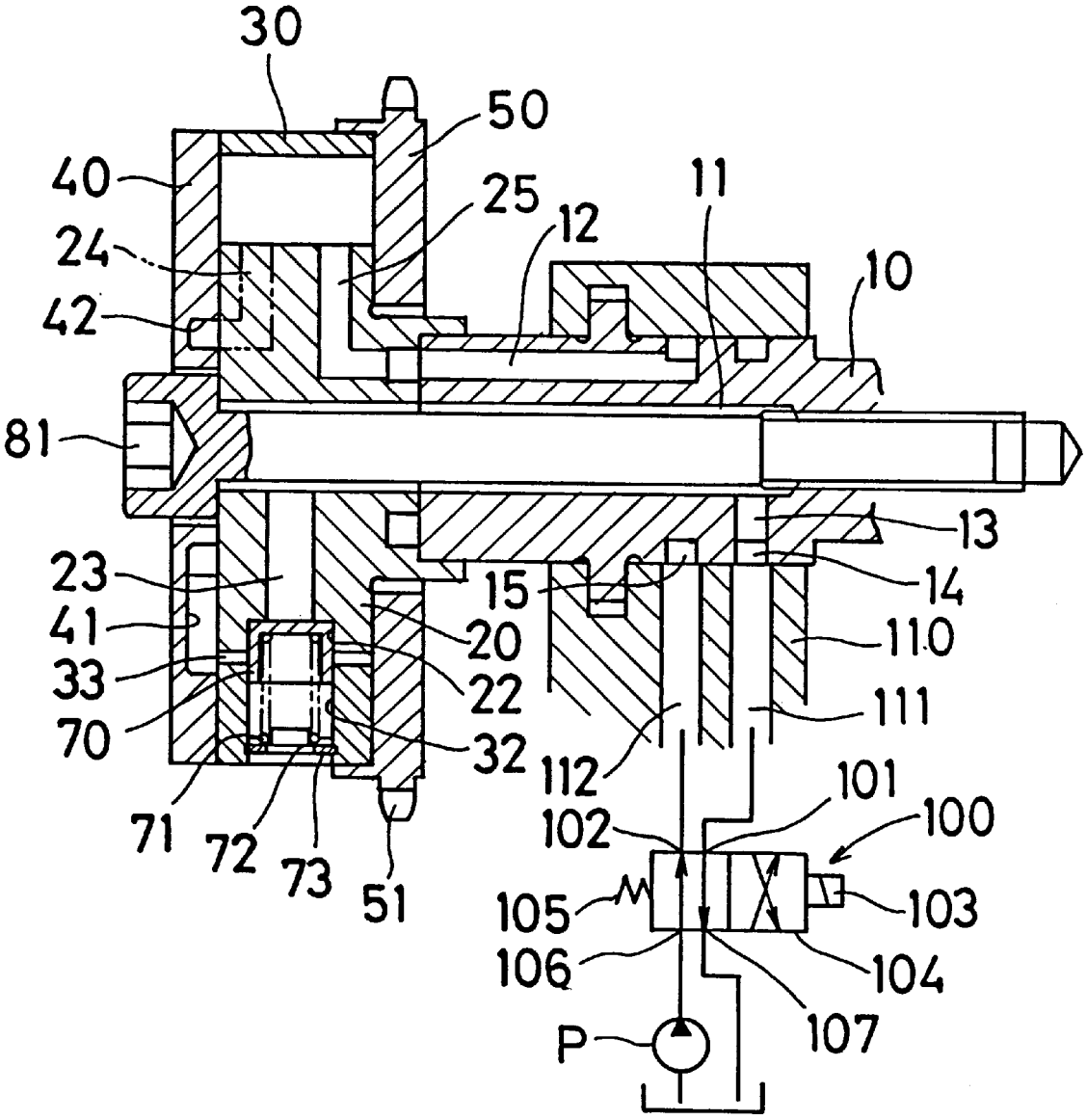
FIG. 1 is a longitudinal section showing one embodiment of a valve timing control device according to the invention.

One embodiment of the invention will be described with reference to the accompanying drawings.

A valve timing control device according to the invention, as shown in FIGS. 1 to 6, is constructed so as to comprise a valve opening/closing shaft including a cam shaft 10 rotatably supported by a cylinder head 110 of an internal combustion engine, and an internal rotor 20 integrally provided on the leading end portion (as located at the lefthand end of FIG. 1) of the cam shaft 10; a rotation transmitting member mounted around the rotary shaft as to rotate relative thereto within a predetermined range and including an external rotator 30, a front plate 40, a rear plate 50 and a timing sprocket 51 formed integrally with rear plate 50; four vanes 60 assembled with the internal rotor 20; and a lock pin 70 assembled with the external rotor 30. Here, the timing sprocket 51 is constructed, as well known in the art, to transmit the rotating power clockwise of FIG. 3 from the not-shown crank shaft through the crank sprocket and a timing chain.

The cam shaft 10 is equipped with the well-known cam (not shown) for opening/closing an intake valve (not shown) and is provided therein with an advance passage 11 and a delay passage 12, which are extended in the axial direction of the cam shaft 10. The advance passage 11 is connected, as shown in FIG. 1, to a connection port 101 of a change-over valve 100 via a radial passage 13 and an annular passage 14, as formed in the cam shaft 10, and via a connection passage 111 formed in the cylinder head 110. On the other hand, the delay passage 12 is connected to a connection port 102 of the change-over valve 100 via an annular passage 15 formed in the cam shaft 10 and via a connection passage 112 formed in the cylinder head 110.

The change-over valve 100 is enabled to move the spool 104 against the action of a spring 105 by energizing a solenoid 103. The change-over valve 100 is so constructed as to establish, when deenergized, the communication between a feed port 106, as connected to an oil pump P to be driven by the internal combustion engine, and the connection port 102 and the communication between the connection port 101 and an exhaust port 107 and as to establish, when energized, the communication between the feed port 106 and the connection port 101 and the communication between the connection port 102 and an exhaust port 107. As a result, the working oil is fed from the oil pump P to the delay passage 12, when the solenoid 103 is deenergized, and to the advance passage 11 when the same is energized. Here, the suction side of the oil pump P and the exhaust part 107 are connected to an oil sump T of the internal combustion engine.

The internal rotor 20 is integrally fixed in the cam shaft 10 by means of a single mounting bolt 81 and is provided with vane grooves 21 for mounting the four vanes 60 individually in the radial directions. Further provided are: a fitting hole 22 for fitting the head portion of the lock pin 70 to a predetermined extent in the state shown in FIGS. 1 to 3, where the cam shaft 10, the internal rotor 20 and the external rotor 30 are synchronized in a predetermined phase (or the most delayed position) relative to one another; a passage 23 for feeding/discharging the working oil to and from the fitting hole 22 via the advance passage 11; passages 24 for feeding/discharging the working oil to and from advancing chambers R1, as defined by the individual vanes 60; and passages 25 for feeding/discharging the working oil to and from delaying chambers R2, as defined by the individual vanes 60, via the delay passage 12. Here, each vane 60 is urged radially outward by a vane spring 61 (as shown in FIG. 1) fitted in the bottom portion of the vane groove 21.

The external rotor 30 is so assembled with the outer circumference of the internal rotor 20 as to rotate relative thereto within a predetermined range. To the two sides of the external rotor 30, there are joined the front plate 40 and the rear plate 50. The external rotor 30 is integrally joined by means of four bolts 82. From the inner circumference of the external rotor 30, moreover, there are projected radially inward four projections 31 which are spaced at a predetermined circumferential interval. The external rotor 30 is so rotatably borne by the internal rotor 20 that the projections 31 are in sliding contact at their inner circumferences with the outer circumference of the internal rotor 20. In each projection 31, there is formed radially of the external rotor 30 a refuge hole 32 for accommodating the lock pin 70 and a spring 71. Further circumferentially formed is a communication recess 33 which has communication with the inner end of the refuge hole 32. The communication recess 33 is given communication with the passages 24 for feeding and discharging the working oil to and from the advancing chambers R1 via recesses 41 and an annular groove 42, as formed in the front plate 40.

Each vane 60 is so mounted between the two plates 40 and 50 and in the vane groove 21 of the internal rotor 20 as to move in the radial direction and to slide at its leading end on the inner circumferential wall of the external rotor 30 thereby to halve a fluid pressure chamber R0, as formed between each projection 31 of the external rotor 30 and the internal rotor 20, into the advancing oil chamber R1 and the delaying oil chamber R2. The vane 60 abuts against a stopper 31*a*, as formed at each of the rotational end faces of the lefthand and upper projections 31 of FIG. 3, thereby to restrict the phase (or the relative rotation) to be adjusted by the valve timing control device.

The lock pin 70 is so assembled in the refuge hole 32 as to slide in the radial direction and is urged toward the internal rotor 20 by the spring 71. This spring 71 is retained between the lock pin 70 and a retainer 72, which is so fixed in the refuge hole 32 as not to come out by a clip 73.

Figure 2:
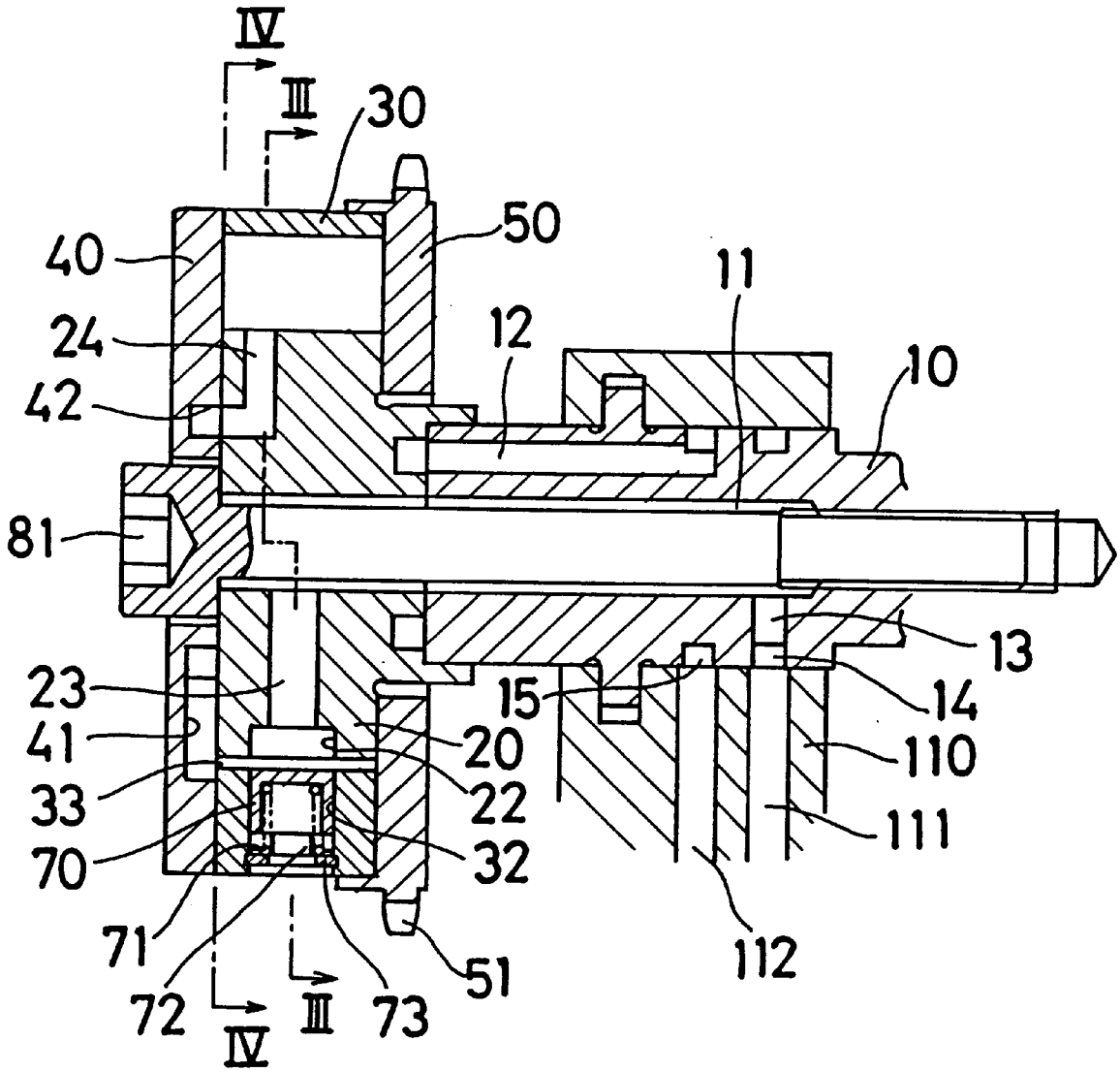
FIG. 2 is a longitudinal section showing the state where a lock pin shown in FIG. 1 is retracted into a refuge hole.
Figure 3:
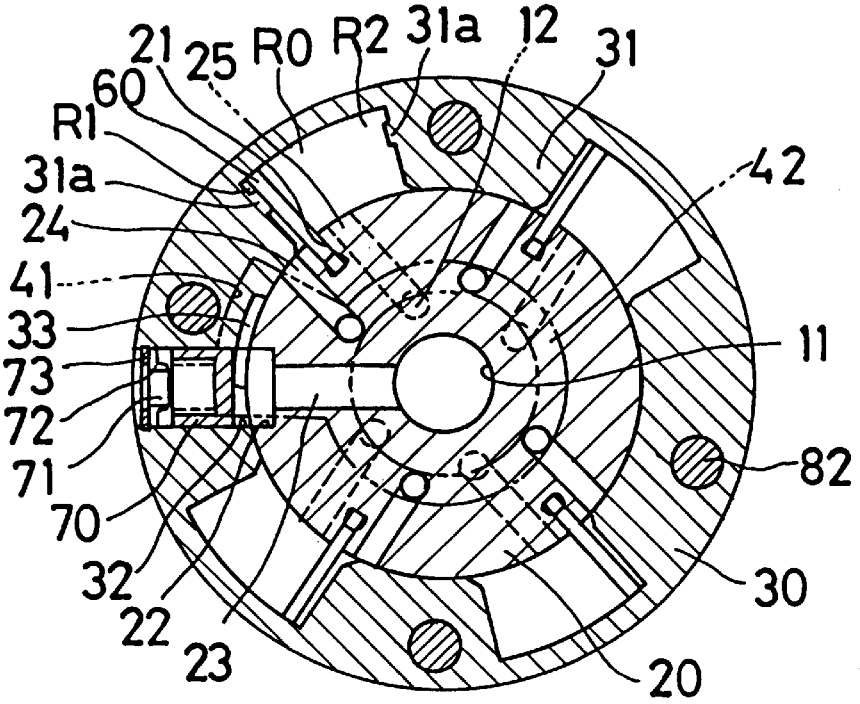
FIG. 3 is a section taken along line 3—3 of FIG. 2.
Figure 4:
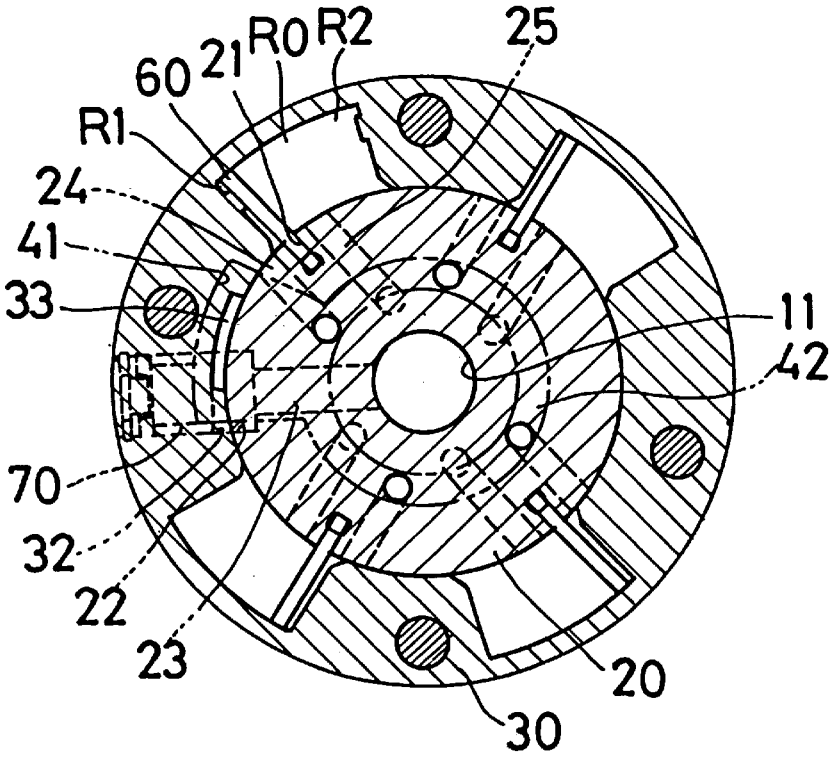
FIG. 4 is an end view taken along line 4—4 of FIG. 2.
Figure 5:
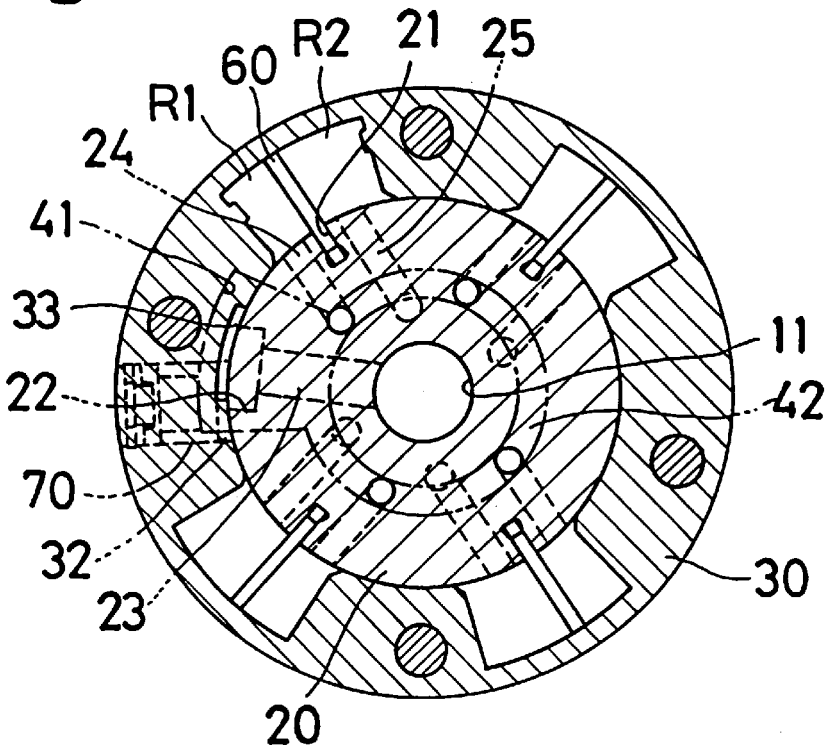
FIG. 5 is an end view showing the state where a rotary shaft such as an internal rotor is rotated by a predetermined stroke from the state of FIG. 4 to an advanced side relative to a rotation transmitting member such as an external rotor.
Figure 6:
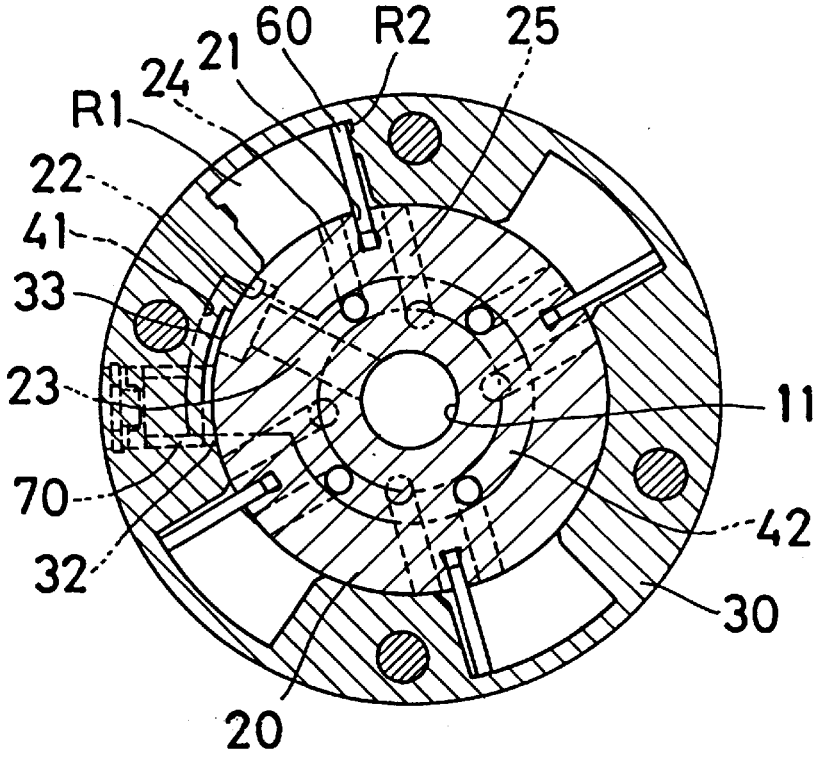
FIG. 6 is an end view showing the state where the rotary shaft such as the internal rotor is rotated by the maximum stroke from the state of FIG. 4 to an advanced side relative to the rotation transmitting member such as the external rotor.

In the valve timing control device thus constructed according to this embodiment, in the state shown in FIG. 1, that is, in the locked state where the head portion of the lock pin 70 is fitted by a predetermined stroke in the fitting hole 22 to regulate the relative rotations of the internal rotor 20 and the external rotor 30 at the most delayed position, the working oil is fed via the passage 23 to the fitting hole when the solenoid 103 of the change-over valve 100 is energized to feed the working oil from the change-over valve 100 to the advance passage 11 of the cam shaft 10. In the state (as shown in FIGS. 2 and 3) where the lock pin 70 is moved against the spring 71 to come out of the fitting hole 22 into the refuge hole 32, the working oil is fed from the passage 23 to the individual advancing chambers R1 via the fitting hole 22, the refuge hole 32, the communication recesses 33, the recesses 41, the annular groove 42 and the passages 24 and is discharged from the individual delaying chambers R2 via the individual passages, the delay passage 12, the change-over valve 100 and so on so that the rotary shaft such as the internal rotor 20 is rotated to the advanced side, as shown in FIGS. 4 to 6, relative to the rotation transmitting member such as the external rotor 30.

In this embodiment, therefore, after the unlocking of the lock pin 70 moved against the spring 71, the displacement transformation (or the relative rotations of the rotary shaft such as the internal rotor 20 and the rotation transmitting member such as the external rotor 30) is started so that it is not disadvantageously blocked by the displacement transformation. When the solenoid 103 of the change-over valve 100 is deenergized in the state of FIGS. 5 and 6 to feed the working oil from the change-over valve 100 to the delay passage 12 of the cam shaft 10, the working oil is fed from the delay passage 12 via the passage 25 to the individual delaying chambers R2 and is discharged via the individual advancing chambers R1, the passages 24, the annular groove 42, the recesses 41, the communication recesses 33, the refuge hole 32, the fitting hole 22, the passage 23, the advance passage 11, the change-over valve 100 and so on so that the rotary shaft such as the internal rotor 20 rotates to the delayed side relative to the rotation transmitting member such as the external rotor 30. At this time, the lock pin 70 is pushed against the spring 71 and held in the retracted state in the refuge hole 32 by the working oil flowing from the individual advancing chambers R1 to the passage 23.

In the foregoing embodiment, the invention has been practiced such that the timing sprocket 51 is integrally mounted on the outer circumference of the rear plate 50 so that the rotating power is transmitted from the cam shaft via the crank sprocket and the timing chain. However, the invention can be likewise practiced such that a timing pulley is integrally mounted on the outer circumference of the external rotor 30 (or the timing pulley can be made of a separate member and integrally fixed) so that the rotating power may be transmitted from the cam shaft via a crank pulley and the timing pulley.

Alternatively, the embodiment has been constructed such that the head portion of the lock pin 70 assembled with the external rotor 30 in the state (or the most delayed state of FIGS. 1 to 4), where the advancing chambers R1 take the minimum capacity, is fitted in the fitting hole 22 of the internal rotor 20. However, the construction can be modified such that the head portion of the lock pin 70, as assembled with the external rotor 30, is fitted in the fitting hole 22 of the internal rotor 20 in the state (or the most advanced state of FIG. 6) where the delaying chambers R2 take the minimum capacity. In this modification, the passage 23 must be communicated with the delay passage 12; the passage 23 must be communicated with the passages 25 via the fitting hole 22, the refuge hole 32, the communication recesses 33, the recesses 41 and the annular groove 42; and the passages 24 must be communicated directly with the advance passage 11.

In the aforementioned embodiment, on the other hand, the invention has been practiced by the valve timing control device to be assembled with the cam shaft 10 for the intake valve. However, the invention can likewise be practiced by a valve timing control device to be assembled with the cam shaft for an exhaust valve. Moreover, this embodiment has been practiced by providing the internal rotor 20 with the vanes 60 and by accommodating the lock pin 70 and the spring 71 in the external rotor 30. Besides this practice, however, the invention can also be practiced by accommodating the lock pin and the spring in the internal rotor and by providing the external rotor with the vanes.

While the invention has been described in detail and with reference to specific embodiments thereof, it will be apparent to one skilled in the art that various changes and modifications can be made therein without departing from the spirit and scope thereof.

What is claimed is:

1. A valve timing control device for controlling the opening and closing timing of an intake valve or an exhaust valve of an internal combustion engine, comprising:

a valve opening and closing rotary shaft assembly rotatably assembled with a cylinder head of the internal combustion engine;

a rotation transmitting member mounted around said rotary shaft so as to rotate relative thereto within a predetermined range for transmitting rotating power from a crank shaft;

vanes provided on one of said rotary shaft assembly and said rotation transmitting member; a fluid chamber formed between said rotary shaft assembly and said rotation transmitting member, and divided into advancing chambers and delaying chambers by said vanes;

first fluid passages for feeding and discharging a fluid to and from said advancing chambers; second fluid passages for feeding and discharging the fluid to and from said delaying chambers;

a refuge hole formed in one of said rotation transmitting member and said rotary shaft assembly for accommodating therein a lock pin spring biased toward the other of said rotary shaft assembly and said rotation transmitting member;

a fitting hole formed in the other one of said rotary shaft assembly and said rotation transmitting member for fitting therein a head portion of said lock pin when said rotary shaft assembly and said rotation transmitting member are synchronized in predetermined relative phases; and a third passage for feeding and discharging the fluid to and from said fitting hole, wherein one of said first fluid passage and said second fluid passage is formed to communicate with said refuge hole so that said one of said first fluid passage and said second fluid passage communicates with said third fluid passage through said refuge hole while said lock pin is out of said fitting hole and in said refuge hole.

2. A valve timing control device for controlling the opening and closing timing of the intake valve or exhaust valve of an internal combustion engine as recited in claim 1, wherein said first fluid passage is connected to said third fluid passage through said refuge hole.

* * * * *

UNITED STATES PATENT AND TRADEMARK OFFICE

CERTIFICATE OF CORRECTION

PATENT NO. : 6,035,816
DATED : March 14, 2000
INVENTOR(S) : Ogawa et al.

It is certified that error appears in the above-identified patent and that said Letters Patent is hereby corrected as shown below:

Item [30],
Please insert -- Foreign Application Priority Data June 5, 1997 [JAPAN] 9-148310 --

Signed and Sealed this

Ninth Day of October, 2001

*Attest:*

Nicholas P. Godici

*Attesting Officer*

NICHOLAS P. GODICI
*Acting Director of the United States Patent and Trademark Office*